US006328387B1

(12) United States Patent
Cooper et al.

(10) Patent No.: US 6,328,387 B1
(45) Date of Patent: Dec. 11, 2001

(54) APPARATUS AND METHOD FOR REMOVING FLOOR COVERING

(75) Inventors: Lyle Aldon Cooper, Roosevelt; Randy Dean Hunter, Lone Wolf, both of OK (US)

(73) Assignee: Lisa Cooper, Honolulu, HI (US)

( * ) Notice: Subject to any disclaimer, the term of this patent is extended or adjusted under 35 U.S.C. 154(b) by 0 days.

(21) Appl. No.: 09/435,457

(22) Filed: Nov. 5, 1999

(51) Int. Cl.[7] ..... B24B 7/18
(52) U.S. Cl. ..... 299/39.6; 299/36.1
(58) Field of Search ..... 299/36.1, 39.1, 299/39.4, 39.6; 451/350, 351, 352, 353

(56) References Cited

U.S. PATENT DOCUMENTS

| | | | | |
|---|---|---|---|---|
| 2,550,749 | * | 5/1951 | Zwoboda et al. | 451/352 |
| 2,680,942 | * | 6/1954 | Portnow | 451/352 |
| 3,161,994 | * | 12/1964 | Neitzer | 451/352 |
| 3,608,969 | * | 9/1971 | Fowkes | 299/39.4 |
| 4,256,344 | * | 3/1981 | Hatcher | 299/39.4 |
| 4,727,686 | | 3/1988 | Persson . | |
| 4,758,050 | | 7/1988 | Peterson . | |
| 4,968,101 | | 11/1990 | Bossow . | |
| 5,070,656 | | 12/1991 | Brogden . | |
| 5,082,330 | | 1/1992 | Holder . | |
| 5,092,658 | | 3/1992 | Smith . | |
| 5,098,506 | | 3/1992 | Brown . | |
| 5,197,784 | | 3/1993 | Holder . | |
| 5,299,857 | * | 4/1994 | Zanetis | 299/39.4 |
| 5,382,084 | * | 1/1995 | Diver et al. | 299/39.4 |
| 5,409,299 | | 4/1995 | Holder . | |
| 5,683,143 | | 11/1997 | Peterson . | |

* cited by examiner

*Primary Examiner*—David Bagnell
*Assistant Examiner*—John Kreck
(74) *Attorney, Agent, or Firm*—Seth M. Reiss

(57) ABSTRACT

An apparatus for removing floor covering consisting of a rotary milling device housed in a frame. The frame is supported, laterally, by hydraulicly powered elevating legs. The lateral legs are lowered to engage the milling device with the floor surface during the cutting phase, and are raised to disengage the milling device from the floor covering and discontinue cutting. While milling, the apparatus is supported by legs fore and aft. The height of the fore and aft legs are manually adjusted, prior to cutting, to affect the depth of the floor removed. The apparatus is powered by an external power source and propelled forward by an energized vehicle through a swivel coupling assembly. The coupling assembly allows the apparatus to be lowered and raised while maintaining a constant orientation relative to the floor surface and to the direction of the propelling force acting upon it. The apparatus is particularly adopted for cutting hard floor surfaces in enclosed areas having narrow access.

19 Claims, 4 Drawing Sheets

APPARATUS AND METHOD FOR REMOVING FLOOR COVERING

BACKGROUND OF INVENTION

1. Field of Invention

The present invention relates generally to an apparatus for removing floor covering including floor surfaces fabricated from hard materials such as concrete, epoxy and stone. More particularly, this invention describes a compact, hydraulicly powered rotary milling device specially housed and propelled for use inside residential and commercial buildings having narrow doorways.

2. Description of the Prior Art

It is often necessary to remove floor covering, as for example in order to refinish floor surfaces when restoring or renovating a building. Floor coverings are composed of materials such as linoleum, tile, concrete, stone and epoxy, the latter of which are among the hardest construction materials. In order to remove hard floor coverings, the apparatus to be employed must be powerful and have cutting heads fabricated from even harder materials.

Apparatus for removing floor coverings are well known and understood, and often take the form of cutting heads and milling devices that are powered separately from the machines that propel them. U.S. Pat. No. 5,409,299, for example, describes a rotary cutting attachment for removing linoleum, tile, and other materials from floors that are attached to and pushed by an operator or small energized vehicle. Also known and understood are self-propelled vehicles, such as the ones described by U.S. Pat. Nos. 5,082,330 and 5,197,783, to which cutting blades or attachments are secured.

Equipment powerful enough to remove hard floor surfaces are normally large and heavy. Floor surface in open areas and large industrial buildings can often accommodate large floor removal apparatus. Smaller industrial buildings, commercial and residential structures, however, have narrow doorways that do not permit the use of heavy equipment without opening a wall. U.S. Pat. Nos. 5,082,330 and 5,197,783 describes small energized vehicles, sufficiently narrow to pass through a 36" doorway. These energized vehicles sometimes employ a structurally independent power source that attaches to the vehicle but remains outside the building.

Rotomills are rotary cutting apparatus well known in the field of removing and resurfacing of asphalt roadways. Rotomill apparatus can employ a variety of cutting heads or tips including tips made of material hard enough to mill hard floor surfaces. Prior art rotomills are not designed for use inside closed structures, and commercially available rotomills are too large to fit through standard doorways.

3. Objects of the Invention

It is a primary object of the present invention to provide an apparatus for removing floor surfaces composed of hard materials such as stone, concrete, and epoxy.

It is a further primary object of the present invention to provide an apparatus for removing floor surfaces that are sufficiently compact and narrow to be able to pass through doorways of residential and commercial buildings.

It is a further object of the present invention to provide an apparatus for removing floor surfaces that is easy to use, maneuver and operate, that can utilize commercially available cutting heads, power sources and propelling vehicles, and that is inexpensive to build and efficient to use.

It is a still further object of the present invention to adopt a rotomill for use in removing hard floor surfaces inside light industrial, commercial and residential buildings, such that the resulting apparatus is less than 36" wide and is powered and propelled by commercially available power sources and vehicles.

SUMMARY OF INVENTION

These and other objects are accomplished in the present invention, an apparatus for removing floor covering comprising a rotomill-type rotary milling device encased in a frame or bell housing. The housing is supported by hydraulicly powered lateral elevating legs with wheels mounted thereon. Fixed legs, fore and aft, also having wheels, can be manually adjusted prior to use.

The rotomill apparatus is attached to and propelled by commercially available energized vehicles having a built in, or alternatively an independent, power supply. A swivel coupling assembly extends from the bottom rear of the bell housing to connect the apparatus to the energized vehicle that propels it. The coupling assembly serves to transfer the force of the vehicle to the rotomill apparatus, while the swivel aspect allows the bell housing to be raised and lowered relative to the vehicle without changing the apparatus' orientation to the floor or the direction of the pushing force upon it.

Hydraulic conduits connect from a hydraulic power source to hydraulic cylinders which comprise the lateral elevating legs, and to the motor which drives the rotary milling device. The hydraulic power source may be contained on the propelling vehicle or the source may be external to both the apparatus and vehicle.

Prior to use, the height of fixed fore and aft legs are adjusted up or down to determine the depth of floor to be removed. Hydraulic pressure applied to the lateral elevating legs raise the bell housing with the milling device enclosed therein. Hydraulic pressure applied to the milling device motor causes the milling drum to rotate. Hydraulic pressure is released from the lateral leg cylinders to lower the bell housing and engage the milling device with the floor surface and begin the cutting phase.

The device continues to cut down into the floor covering until the wheels mounted on the fore and aft legs rest on the floor surface. The propelling vehicle pushes the rotomill apparatus causing floor covering to be removed in a forward direction leaving a cutting path the diameter of the milling device. The bell housing is raised, through the application of hydraulic pressure to the lateral elevating legs, to end the cutting phase or when turning or otherwise maneuvering the apparatus.

Further objects and advantages of this invention will become apparent from consideration of the drawings and ensuing description.

BRIEF DESCRIPTION OF THE DRAWINGS

The details of typical, but not limiting, embodiments of the present invention will be described in connection with the accompanying drawings.

DETAILED DESCRIPTION OF THE PREFERRED EMBODIMENTS

Figure 1:
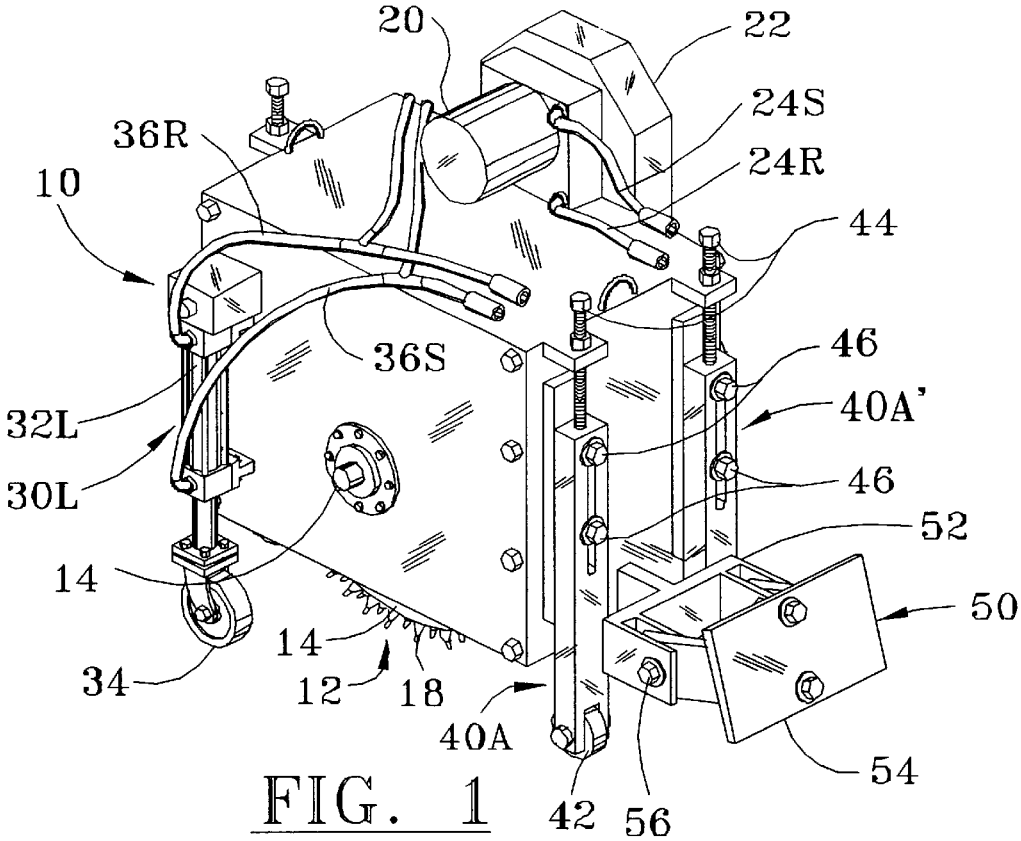
FIG. 1 is a perspective view of the left side, top and rear of the apparatus of the present invention, showing the swivel coupling assembly extending from the bottom rear thereof.

A preferred embodiment of the apparatus for removing floor covering of the present invention is illustrated in FIG. 1. A frame or bell housing 10 encloses a rotary milling device 12. Milling device 12, of the type sometimes referred to as a rotomill, is comprised of a cutting drum 14 which rotates about an axle 16. A plurality of cutting bits 18 project out from the outside surface of drum 14. Cutting bits 18 are removably inserted into drum 14 and fabricated from hard material such as tungsten or carbide.

Milling device 12 is powered by a hydraulic motor 20 which, according to the embodiment shown, is mounted on the top right side of bell housing 10. Power is transferred from motor 20 to milling device 12 by a drive belt (not shown) encased in belt housing 22. A hydraulic supply hose 24S and return hose 24R extend from motor housing 20. Supply hose 24S and return hose 24R each end with a hose connector 26.

Hydraulic fluid and pressure from an external source (not shown) is supplied to motor 20 through connector 26 and hose 24S. The fluid cycles through motor 20 and then is returned to the external source through hose 24R and connector 26. The rotating force of motor 20 is transferred to drum 14 through the drive belt encased in belt housing 22 causing drum 14 to rotate, according to this embodiment in a clockwise direction. Rotating drum 14 drives cutting bits 18 to cut first downward, and then upward, through the surface that lies below bell housing 10.

Figure 2:
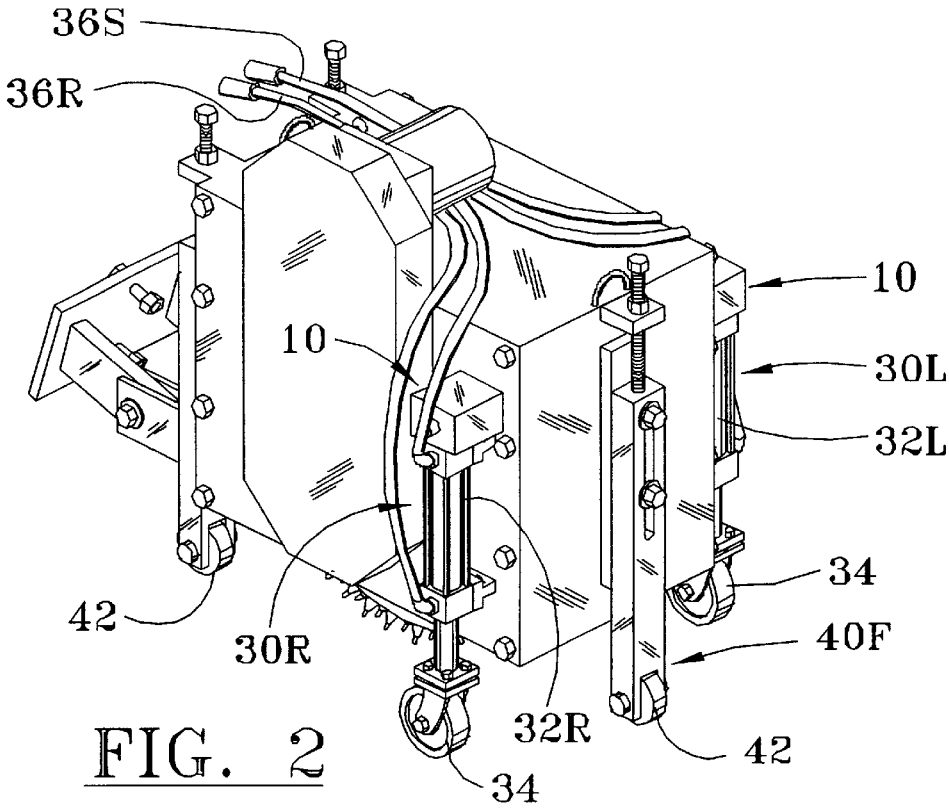
FIG. 2 is a perspective view of the opposite side, top and front of the apparatus.

Bell housing 10 is supported by adjustable fixed legs fore and aft, and hydraulicly powered elevating legs laterally, as can be seen best by reference to both FIGS. 1 and 2.

A hydraulicly powered left elevating leg 30L, shown in FIG. 1, is comprised of a left leg cylinder 32L secured to the left side of bell housing 10. A side wheel 34 is mounted on the bottom of leg 30L. A right elevating leg 30R with right leg cylinder 32R and side wheel 34 (shown in FIG. 2) is a mirror image of left leg 30L and is secured to the right side of bell housing 10. A leg cylinder supply hose 36S and a leg cylinder return hose 36R connect, at one end, to the bottom and top, respectively, of each leg cylinder 32. At their other end supply hoses 36S, which supply hydraulic fluid to the right and left leg cylinders 32R and 32L, connect to one another in a "T" formation before terminating in a hose connector 26. Similarly, return hoses 36R, which return hydraulic fluid from the right and left leg cylinders 32R and 32L, connect to each other in a "T" formation before terminating in a hose connector 26.

According to the preferred embodiment depicted, two aft fixed legs 40A and 40A' are secured to the rear of housing 10, while a single fixed fore leg 40F (shown in FIG. 2) is secured to the front of housing 10. Mounted at the bottom of each fixed leg 40A, 40A' and 40F is a wheel 42. Extending from the top of each fore or aft leg 40 is an adjusting bolt 44. Securing fixed leg 40 to bell housing 10 are two securing bolts 46.

Bell housing 10 is raised and lowered relative to the floor by applying and releasing hydraulic pressure supplied to lateral leg cylinders 32. Increasing the flow of hydraulic fluid and pressure through supply hoses 36 expand leg cylinders 32 and raises bell housing 10. Releasing the hydraulic fluid and pressure through return hoses 38 allows leg cylinders 32 to contract under the weight of bell house 10 and bell housing 10 is lowered thereby.

The height of fixed fore and aft legs 40 determines the height of bell housing 10 and milling device 12 relative to the floor when the hydraulic pressure in leg cylinders 32 is fully released and the lateral legs 30 contract. The height of fore and aft legs 40 are adjustable, manually, by screwing and unscrewing adjusting bolt 44. Prior to adjustment, securing bolts 46 are loosened. Next adjusting bolt 44 is screwed clockwise, or counter-clockwise, depending upon whether more or less height is desired. Once the desired height is achieved, securing bolts 46 are re-tightened to re-secure fixed legs 40 to bell housing 10.

Extending from the lower back of bell housing 10 is swivel coupling assembly 50. Assembly 50 is comprised of a swivel bracket 52 rotatably joined to a swivel face plate 54 by means of a pair of swivel pins 56.

Figure 3:
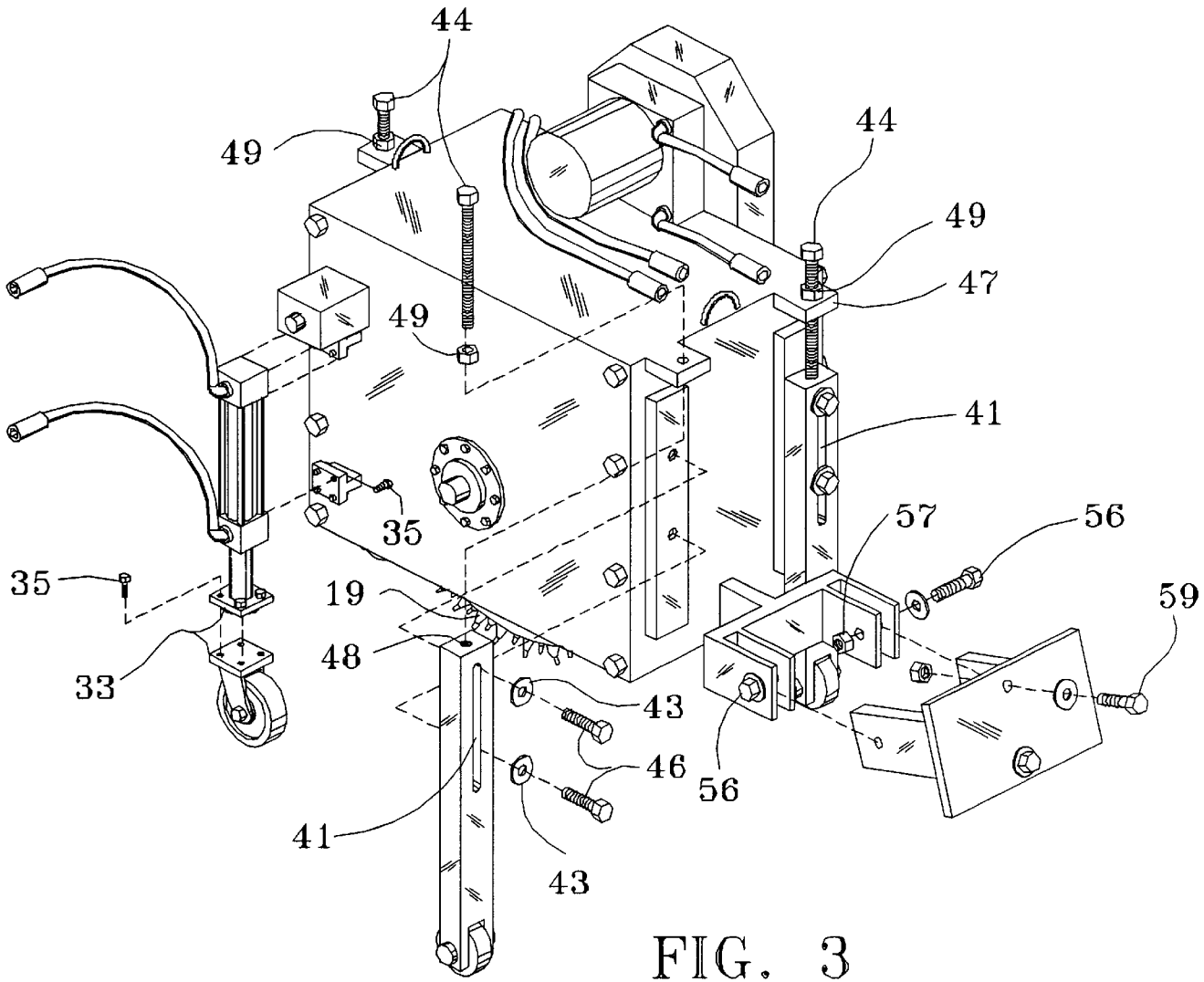
FIG. 3 is an exploded view of the apparatus from the perspective taken in FIG. 1.

FIG. 3 illustrates the apparatus of the present invention, from the perspective of FIG. 1, but in exploded view. Milling device 12 is secured within bell housing 10 by means of drum axle 16. The base of cutting bits 18 are removably inserted into receiving slots 19 cut into the outside surface of cutting drum 14. Hydraulic motor 20 attaches to the top of belt housing 22. Belt housing 22 attaches along the right side of bell housing 10. Supply and return hoses 24S and 24R attach to bottom and top, respectively, of motor 20.

Left elevating leg 30L is comprised of left leg cylinder 32L mounted on top of side wheel 34 and along the left side of bell housing 10 by means mounting plates 33 and mounting bolts 35. One end of a hydraulic supply hose 36S connects to the bottom portion of leg cylinder 32L. The opposite end of supply hose 36S connects with hose 36S emanating from right leg cylinder 32R (shown in FIG. 2) to terminate in hose connector 26. Similarly, one end of a hydraulic return hose 36R connects to the top portion of leg cylinder 32L. The opposite end of return hose 36S connects with hose 36R emanating from right leg cylinder 32R (shown in FIG. 2) to terminate in hose connector 26.

Connecting the two supply and return hoses 36S and 36R that connect to left and right leg cylinders 32L and 32R to each other, in a "T" configuration, serves to ensure that the hydraulic pressure within left and right cylinders 32R and 32L are equal. Equal pressure in leg cylinders 32R and 32L results in symmetrical raising and lowering of the right and left sides of bell housing 10. It will be appreciated by those skilled in the hydraulic arts, however, that alternative embodiments are possible in which supply and return hoses 36S and 36R connect independently to a hydraulic power source and are controlled in unison or independently. Such alternative embodiments can be employed without department from the scope and intent of the present invention.

Also depicted in FIG. 3 is the means of securing and adjusting fixed legs 40. Aft fixed leg 40A is rectangular in cross-section with a groove 41 along its upper portion to accommodate securing bolts 46. Secured to the bottom of leg 40A is wheel 42. Leg 40A is secured to the rear of bell housing 10 by means of securing bolts 46 each having a washer 43. Bolts 46 penetrate groove 41 and are received by holes formed in mounting plates 45 secured along the rear of bell housing 10.

The height of leg 40A is adjusted, manually, by means of adjusting bolt 44. A hole 48 is tapped into the top of leg 40A and into a tab 47 which extends from the top rear of bell housing 10. Holes 48 are threaded to accommodate adjusting bolt 44. Adjusting bolt 44 is screwed first into a lock nut 49 and then through hole 48 in tab 47 before being received into the top of leg 40A. Lock nut 49 is loosened, as are securing bolts 46, prior to adjusting the height of leg 40A, and both lock nut 49 and securing bolts 46 are tightened once the desired height is achieved.

Normally, aft legs 40A and 40A' are adjusted for equal height. Fore leg 40F (shown in FIG. 2) may be adjusted to be shorter than aft legs 40A and 40A' in order to accommodate the difference in floor heigh between the cut floor surface, upon which aft legs 40A and 40A' will be riding, and the uncut floor surface, upon which fore leg 40F will be riding. In this case, the height of fore leg 40F should be set equal to or higher than lateral legs 30 when the hydraulic pressure in legs cylinders 32 is released and legs 30 are in their lowered configuration, and the height of aft legs 40A and 40A' should be set higher than fore leg 40F by a dimension equal to the dimension of floor depth to be cut.

Also illustrated in FIG. 3 are the component parts and manner of assembly of swivel coupling assembly 50. The base of swivel bracket 52, depicted here demonstrating a "Y" configuration, is permanently adhered to the bottom rear of bell housing 10. Two pairs of receiving arms 53 which extend from the base of bracket 52 pivotally engage two extending arms 55 which extend from the back of swivel face plate 56. Right and left swivel pins 56 are directed inward and inserted through corresponding holes drilled through arms 53 and 55. Swivel pins 56 are secured from within the coupling assembly by means of nuts 57. Holes drilled in face plate 54 accommodate face plate bolts 59 which are used to secure coupling assembly 50 to the mirror image coupling assembly (shown in FIGS. 4 and 5) which extends from propelling vehicle.

Figure 4:
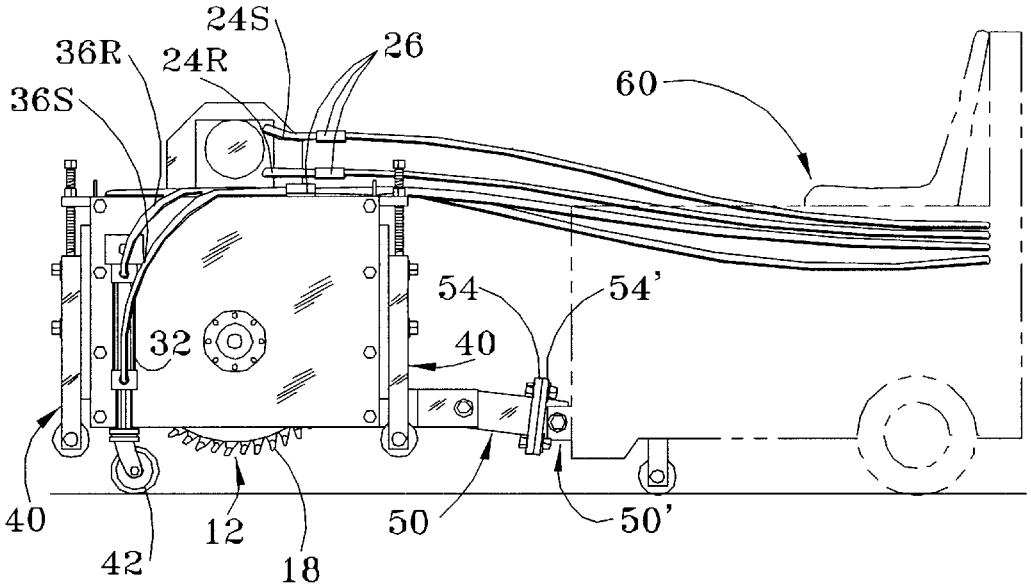
FIG. 4 is a plan view of the apparatus with bell housing raised so as not to be engaged to out floor covering, coupled to an energized vehicle.
Figure 5:
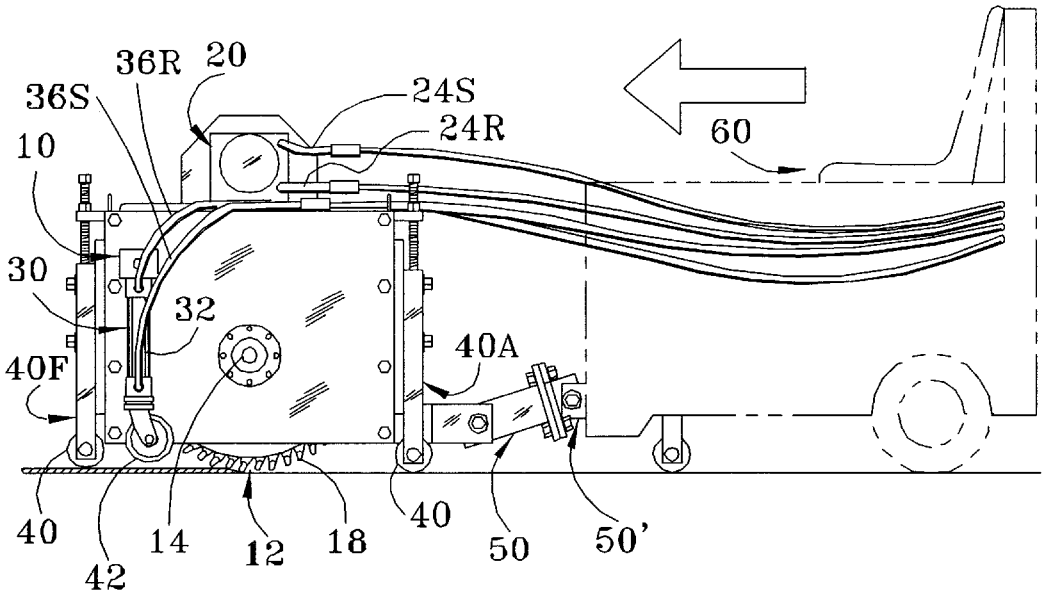
FIG. 5 is a plan view of the apparatus with bell housing lowered during the cutting phase while propelled by an energized vehicle.

The manner in which the apparatus of the present invention is coupled to and propelled by an energized vehicle is illustrated in FIGS. 4 and 5. A compact energized vehicle 60 has a narrow width that allows it, together with the apparatus of the present invention, to pass through narrow doorways of residential and commercial structures. Vehicle 60 will usually be hydraulicly powered and can take the form of commercially available hydraulic floor strippers. Vehicle 60 may have a built-in power source, or it can be powered by an independent power source that remains outside the structure and connects to vehicle 60 by means of hose conduits.

Referring first to FIG. 4, a swivel coupling assembly 50', that is a mirror image of swivel coupling assembly 50 attached to the floor removal apparatus, extends from and is secured to the front of vehicle 60. Opposing face plates 54 and 54' are bolted one to the other to couple the floor removal apparatus to energized vehicle 60. Hydraulic supply and return hoses, 24S, 24R, 36S and 36R, are interconnected with supply and return hoses found on vehicle 60 through hose connectors 26.

The floor removal apparatus shown in FIG. 4 is in raised position prior to the cutting phase. In raised position, milling device 12 with cutting bits 18 is above the floor surface as are fixed fore and aft wheels 42. The raised position is achieved by supplying hydraulic pressure through supply hoses 36S to leg cylinders 32 causing elevating legs 30 to rise. It is in this raised position, prior to milling, that the height of fore and aft legs 40 are adjusted in accordance with the depth of floor covering to be removed.

FIG. 5 shows the apparatus of the present invention in lowered position during the cutting phase. Milling device 12 with cutting bits 18 are engaged in cutting the floor surface. To achieve this position, hydraulic pressure from leg cylinders 32 is released through return hoses 36R allowing lateral legs 30 to contract until wheels 42 attached to fore and aft legs 40 rest on top of the floor surface. Fore leg 40F is somewhat shorter than aft legs 40A in order to accommodate the difference between the height of the cut and uncut floor surface.

Also during the cutting phase depicted in FIG. 5, hydraulic pressure is being supplied through supply hose 24S to hydraulic motor 20 to drive milling device 12. At the same time the entire floor removal apparatus is being propelled forward by energized vehicle 60 by means of forces transferred through coupling assemblies 50 and 50'. The propelling force transferred from vehicle 60 causes cutting bits 18 to engage and mill floor covering in a forward direction leaving a cutting path the width of cutting drum 14.

Because coupling assemblies 50 and 50' are designed to swivel, bell housing 10 can be raised and lowered using hydraulicly powered elevating legs 30 without changing the orientation of the floor removal apparatus relative to the floor surface. Also because of the flexible coupling assemblies 50 and 50', the direction of the propulsive force being acted upon the floor removal apparatus by energized vehicle 60 remains constant notwithstanding raising and lowering the apparatus.

Figure 6:
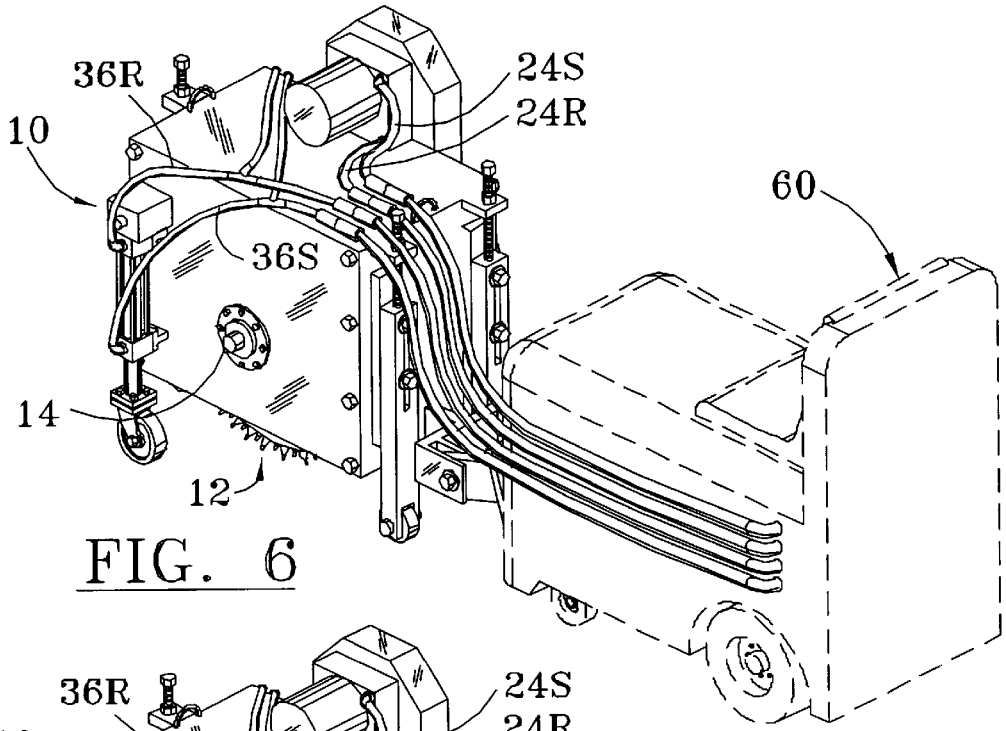
FIG. 6 is a perspective view of the apparatus of the present invention coupled to an energized vehicle that houses a hydraulic power source.
Figure 7:
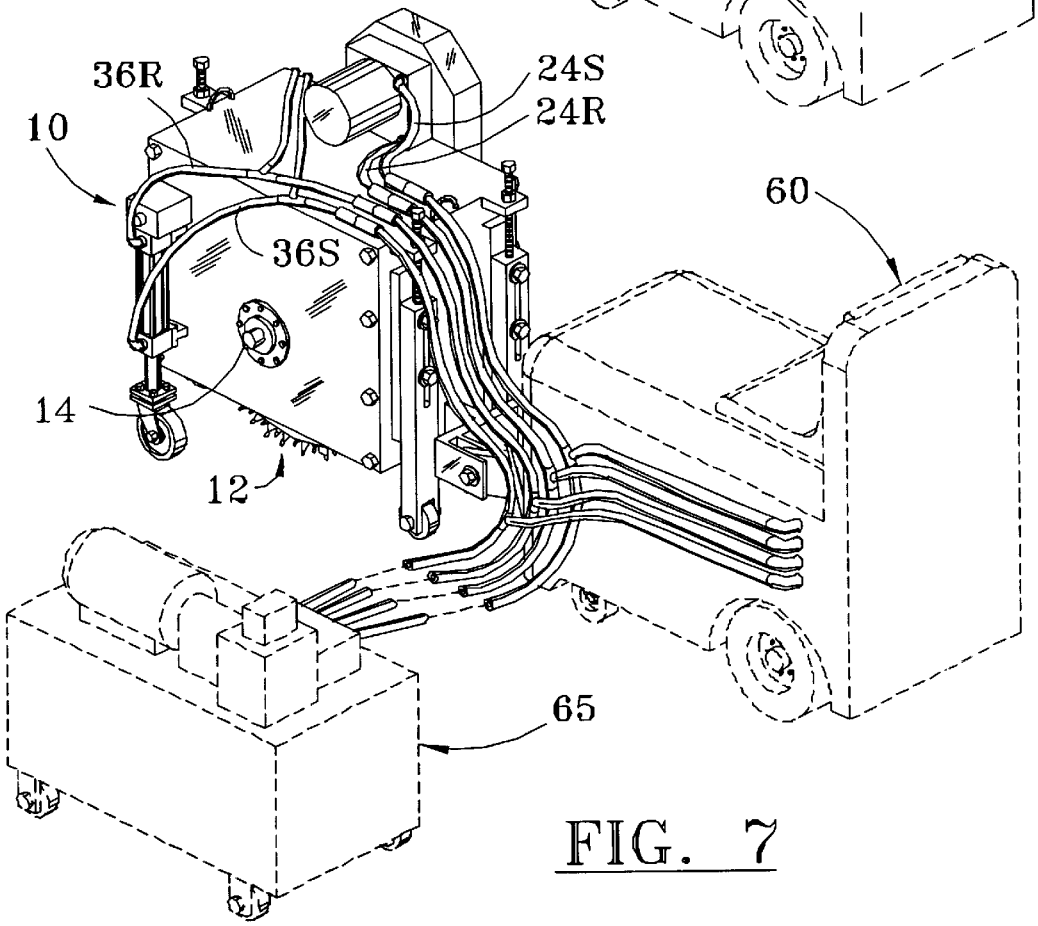
FIG. 7 is a perspective view of the apparatus coupled to an energized vehicle both of which are supplied hydraulic power from an independent source.

FIG. 6 shows the apparatus of the present invention powered by a power source housed within energized vehicle 60. FIG. 7 shows the apparatus of the present invention powered by a self-contained independent power source 65. According to the embodiment in FIG. 6, a power source enclosed within vehicle 60 supplies fluid under pressure to the motor and elevating legs mounted on bell housing 10 through hoses 24S and 36S, while hydraulic fluid is returned to the enclosed power source within vehicle 60 through hoses 24R and 36R. According to the embodiment in FIG. 7, independent power source 65 supplies fluid under pressure to both energized vehicle 60 and the motor and elevating legs mounted on bell housing 10 through hoses 24S and 36S, while hydraulic fluid is returned to independent power source 65 through hoses 24R and 36R. Independent power source 65 can be located within the premises in the vicinity of the apparatus and vehicle 60, or at some distance from the apparatus. Where independent power source 65 is wider than the threshold of the structure in which flooring is to be removed, power source 65 can be left outside the structure while the apparatus with bell housing 10 and vehicle 60 are being operated inside the structure. As such, the size of independent power source 65 does not become an issue for residential jobs or when servicing other structures with narrow access.

While the apparatus for removing floor covering of the present invention has been described and illustrated as supported by hydraulicly powered elevating legs 30 which are lateral relative to bell housing 10, it will be appreciated that two or more elevating legs 30 on each side of bell housing 10 could be substituted therefore, or that the elevating legs 30 could be mounted fore and aft of housing 10 with adjustable fixed legs 40 being mounted laterally on housing 10. Similarly, two fore legs 40 could be used in place of the one fore leg 40F shown in FIG. 2, and means of powering elevating legs 30, other than hydraulics, could be employed without departing from the spirit and intent of the instant invention.

In addition, those skilled in the art will understand that a variety of prior art cutting and milling tools, blades, heads and attachments can be substituted for milling device 12, cutting drum 14, and cutting bits 18, to achieve similar or different cut textures and cutting efficiencies, and to address different types of floor covering materials. Also, alternative types of power can be substituted for hydraulic power to operate these cutting and milling tools.

SUMMARY AND SCOPE

Accordingly, it will be readily appreciated that the apparatus for removing floor covering of the present invention provides a compact but powerful device that can be employed to remove floor surfaces composed of very hard flooring materials inside light industrial, commercial and residential structures with narrow entrances and egresses, quickly, efficiently, and with minimal effort and expense. The apparatus is powered and propelled by commercially available floor strippers and hydraulic power sources and is narrow enough to fit through conventional doorways. It adopts the successful rotomill cutting technology for use inside a variety of structures, in a manner that takes advantage of known and available sources of power and propulsion.

Although the description above contains many specifications, these should not be construed as limiting the scope of the invention but as merely providing illustrations of some of the presently preferred embodiments of this invention. For example, alternative means for propelling the floor removal apparatus of the present can be substituted for energized vehicle 60 depicted in FIGS. 4 and 5, such as a propelling means built into bell housing 10 that drives fixed legs 40, without departing from the spirit and intent of the present invention.

Thus the scope of the invention should be determined by the appended claims and their legal equivalents, rather than by the examples given.

The embodiments of the invention in which an exclusive property or privilege is claimed are defined as follows:

1. An apparatus for removing floor covering comprising:

a frame;

a cutting means mounted within said frame and extending below the bottom thereof;

a plurality of elevating support means mounted to and extending downward from opposing lateral sides of said frame having wheels attached thereto;

a plurality of length adjustable support means mounted to and extending downward from opposing fore and aft sides of said frame having wheels attached thereto;

wherein said elevating support means lower and raise the apparatus to engage and disengage said cutting means with said floor covering; and wherein adjusting the length of said length adjustable support means determines the depth of the floor covering to be removed.

2. The apparatus of claim 1 wherein said cutting means is a drum rotatably mounted within said frame with cutting heads mounted thereon.

3. The apparatus of claim 2 wherein the rotating drum is powered by a hydraulic motor mounted in said frame.

4. The apparatus of claim 3 wherein said cutting heads are bits extending radially outward from said drum.

5. The apparatus of claim 4 wherein said bits are tipped with a material selected from the group consisting of tungsten and carbide.

6. The apparatus of claim 1 wherein said elevating support means are hydraulically powered.

7. The apparatus of claim 1 further comprising a means for propelling said frame in a forward direction over the surface of said floor.

8. The apparatus of claim 7 wherein the power for said propelling means, said cutting means and said elevating support means is hydraulic pressure supplied through conduits from an independent power source.

9. The apparatus of claim 7 wherein said propelling means is an energized vehicle that pushes said apparatus.

10. The apparatus of claim 9 wherein said energized vehicle is powered by a source which also supplies power to said cutting means and said elevating support means.

11. The apparatus of claim 9 further comprising a means for coupling said energized vehicle to said frame whereby the direction of the pushing force of said vehicle on said frame remains constant as said frame is raised and lowered.

12. The apparatus of claim 11 wherein said coupling means comprises a face plate pivotally mounted to the rear of said frame which communicates with a face plate pivotally mounted to the front of said energized vehicle.

13. A method for removing floor covering comprising the steps of:

providing an apparatus having a frame, a means for cutting floor covering mounted within said frame and extending below the bottom thereof, a plurality of elevating support means mounted to and extending downward from opposing lateral sides of said frame with wheels attached thereto, and a plurality of length adjustable support means mounted to and extending downward from opposing fore and aft sides of said frame with wheels attached thereto;

energizing said elevating support means to raise said frame with cutting means above the floor surface;

adjusting the length of said length adjustable support means such that the lowest portion of said cutting means extends below the bottom of the wheels attached to said length adjustable support means by a distance equal to the depth of the floor covering to be removed;

activating said cutting means;

de-energizing said elevating support means to lower said frame with cutting means until the wheels attached to said length adjustable support means rests on said floor covering and said cutting means is engaged in cutting said floor covering;

re-energizing said elevating support means to raise said frame with cutting means until said cutting means disengages from and discontinues cutting the floor covering; and de-activating said cutting means.

14. The method of claim 13 wherein the length of the fore length adjustable support means is adjusted in the manner described in claim 13 while the length of the aft length adjustable support means is adjusted such that the bottom of the wheels attached to said aft support means are level with the lowest portion of said cutting means.

15. The method of claim 14 wherein said apparatus is propelled in a forward direction during cutting by a propelling means.

16. The method of claim 15 wherein said propelling means is an energized vehicle that pushes said apparatus across the floor during cutting.

17. The method of claim 16 further comprising a means for coupling said energized vehicle to said frame whereby the direction of force of said energized vehicle on said frame remains constant while said frame is raised and lowered.

18. The method of claim 17 wherein said coupling means comprises a face plate pivotally mounted to the rear of said frame which communicates with a face plate pivotally mounted to the front of said propelling means.

19. An apparatus for removing floor covering comprising:

a frame;

a cutting means mounted within said frame and extending below the bottom thereof;

a plurality of elevating support means mounted to and extending downward from opposing sides of said frame having wheels attached thereto;

a plurality of length adjustable support means mounted to and extending downward from opposing sides of said frame having wheels attached thereto;

a means for propelling said frame in a forward direction over the surface of said floor covering;

wherein said elevating support means lower and raise the apparatus to engage and disengage said cutting means with said floor covering;

wherein adjusting the length of said length adjustable support means determines the depth of the floor covering to be removed, and wherein the power for said propelling means, said cutting means and said elevating support means is hydraulic pressure supplied through conduits from an independent power source.

* * * * *